US005094359A

United States Patent [19]

DeMars et al.

[11] Patent Number: 5,094,359

[45] Date of Patent: Mar. 10, 1992

[54] COMBINATION PACKAGING/SHIPPING CARTON AND ICE BUCKET

[76] Inventors: Robert A. DeMars, 23221 Ladrillo Ave., Woodland Hills, Calif. 91367; Spencer L. Mackay, 28765 Pisces St., Agoura Hills, Calif. 91301

[21] Appl. No.: 724,187

[22] Filed: Jul. 1, 1991

[51] Int. Cl.[5] ..... B65D 5/46; B65D 5/56

[52] U.S. Cl. ..... 220/462; 220/410; 229/101; 229/103; 229/138; 229/186

[58] Field of Search ..... 220/410, 462; 229/101, 229/103, 138, 155, 186, 114

[56] References Cited

U.S. PATENT DOCUMENTS

| | | | |
|---|---|---|---|
| 1,666,294 | 4/1928 | Downes-Martin | 229/101 |
| 2,398,200 | 4/1946 | Van Voorhis | 229/186 |
| 2,704,184 | 3/1955 | Martin | 229/101 |
| 2,810,506 | 10/1957 | Kessler | 229/138 |
| 3,081,017 | 3/1963 | Gerbino | 229/155 |
| 3,150,812 | 9/1964 | Sabol | 229/101 |
| 3,502,488 | 3/1970 | Bridgford | 229/138 |
| 3,559,869 | 2/1971 | Reynolds | 229/114 |
| 3,581,977 | 6/1971 | Kirsky et al. | 229/138 |
| 4,148,429 | 4/1979 | Burr et al. | 229/186 |

*Primary Examiner*—Gary E. Elkins
*Attorney, Agent, or Firm*—Jack C. Munro

[57] ABSTRACT

A combination packaging/shipping carton and ice bucket for a plurality of can or bottled type of beverage containers, wherein the carton assumes a minimum volume position during packaging and shipping then can be moved to an expanded or increased volume position when it is intended to be used as an ice bucket. Each corner of the carton includes triangular webs which move from an abutting together position to a substantially in-line position during movement of the carton to the increased volume position. The side and end panels of the carton have attached thereto foldable flaps which fold over upon theirselves, when the carton is in the minimum volume position, closing the enclosing chamber of the carton to the ambient. When these foldable flaps are moved away from each other to assume a substantial in-line position with their respective side panel and end panel, the enclosing container is open to the ambient with this enclosing container increasing in size to permit usage of the carton as an ice bucket.

8 Claims, 2 Drawing Sheets

COMBINATION PACKAGING/SHIPPING CARTON AND ICE BUCKET

BACKGROUND OF THE INVENTION

The field of this invention relates to cartons and more particularly to a packaging/shipping carton for a plurality of can or bottle type of beverage container which then permits the carton to be utilized as an ice bucket by applying ice to the beverage containers for keeping such cold which frequently is a more common temperature for consumption of the beverage.

The selling to consumers of soft drinks and beer in bottle and can containers (commonly 12 ounces) is an exceedingly common practice. It is also exceedingly common to sell a collected number of such containers as a "six pack" or a "twelve pack."

It is generally intended to have the beverage consumed at a temperature substantially less than ambient temperature. Normally, the consumer would purchase the beverage at a store and then would transfer the beverage to a typical ice chest which is in widespread use. Thereafter, the consumer would then obtain a quantity of ice and place the ice on top of the beverage containers which functions to cool the contents of the beverage containers prior to being consumed.

A typical six pack or twelve pack container is constructed of paperboard and is intended to be discarded once the beverage containers have been removed from the paperboard carton. In the past, there has been attempts at incorporating an ice bucket in conjunction with the packaging/shipping carton for the beverage containers. However, these attempts at combining of the packaging/shipping carton and ice bucket proved ineffective and are not being used due to being complex, costly, difficult to manufacture, difficult for the consumer to operate, leaks water as the ice melts, etc. None of these prior art containers have experienced any widespread usage.

SUMMARY OF THE INVENTION

The subject matter of this invention is directed to a new and novel combination packaging/shipping carton and ice bucket designed for packaging and shipping of a plurality of beverage containers. The consumer is to open the carton prior to usage which will cause the carton to assume an expanded volume permitting applying of a quantity of ice onto the beverage containers. Interiorly the carton includes a removable water impermeable liner such as a plastic bag. The carton is normally closed by foldable flaps which are located in an overlapping relationship. Incorporated with these flaps is a handle to facilitate carrying of the carton by the consumer. Each corner of the carton includes a pair of triangularly shaped webs which permits the carton to assume the increased volume position to be usable as an ice bucket.

Principal objects of the present invention ar to provide a carton of rigid durable construction which can be quickly and easily formed from a blank of sheet material, to provide a carton adapted to carrying of heavy weight goods such as bottled beverage containers, to provide a carton which will firmly hold the beverage containers therein in a tightly packed condition so is to prevent rattling of the containers within the carton during shipping, which can be easily moved to the ice bucket position by the consumer without requiring the use of special skills, is inexpensive to manufacture and therefore inexpensive to purchase by the consumer when purchasing of the carton and the beverage containers that it holds.

Another objective of the present invention is to construct a carton which can be manufactured by existing carton manufacturing equipment eliminating the need for designing special equipment.

DETAILED DESCRIPTION OF THE SHOWN EMBODIMENT

Figure 1:
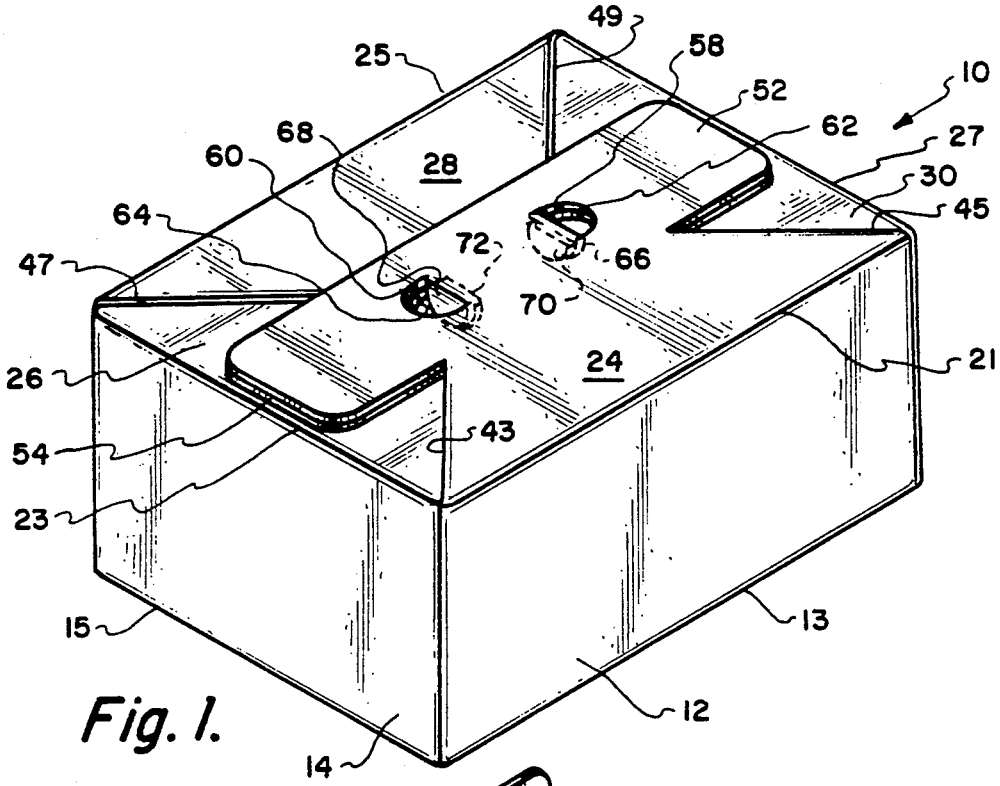
FIG. 1 is an isometric view of the carton of the present invention showing the carton in the closed position to be the position normal for shipping.

Referring particularly to the drawings, there is shown the carton 10 of this invention. Carton 10 is basically in the shape of a rectangular box and is formed of a pair of sheet material, parallel, spaced apart, side panels 11 and 12. Both side panels 11 and 12 are of the same size. Side panel 12 defines a bottom edge 13 and a top edge 21. Side panel 11 has a bottom edge 19 and a top edge 25. Located between each pair of aligned end edges of the side panels 11 and 12 is an end panel of end panels 9 and 14. These end panels 9 and 14 are also located parallel to one another and are of the same size and of the same material as the side panels 11 and 12. It is understood the side panels 11 and 12 and the end panels 9 and 14 are actually to be formed from a blank of material. The end panel 14 includes a bottom edge 15 and a top edge 23. The end panel 9 includes a bottom edge 17 and a top edge 27.

Integrally connected to the side panel 12 are webs 16. It is to be understood that there is to be a web 16 located at each end of the side panel 12. There is also a web 16 located at each end of the side panel 11. Each web 16 is triangularly shaped with the apex of the triangle located at the bottom edge 13. The webs 16 are capable of pivoting relative to their respective side panel 11 or 12.

In a similar manner there is a similarly shaped triangularly shaped web 18 integrally connected at each lateral edge of the end panels 9 and 14. Therefore, there are four in number of the webs 16 and four in number of the webs 18.

Integrally connected to the web 16 at the top edge 21 is a foldable flap 20. A similar foldable flap 22 is integral with the web 18 and is located at the top edge 23. Flap 20 includes a longitudinal extension 40 with flap 22 including a longitudinal extension 42. These extensions 40 and 42 are to be permanently glued together forming a flange and are located within the enclosing container defined by the carton 10.

The folded flaps 20 and 22 and the extensions 40 and 42 are shown at the right side edge of the end panel 14. At the left side edge of the end panel 14 there is located in a similar arrangement foldable flaps 32 and 34 and longitudinal extensions 44 and 46. The right side edge of the end panel 9 includes foldable flaps 36 and 38 and their respective longitudinal extensions 48 and 50. The left side edge of end panel 9 includes foldable flaps 39 and 41 as well as longitudinal extensions (not shown). Each pair of abutting longitudinal extensions (44 and 46, 48 and 50 plus the unnumbered pair) form a flange.

Connecting the foldable flaps 36 and 39 is a foldable flap 30 which is integrally attached to the to edge 27 of end panel 9. In a similar manner, foldable flaps 22 and 34 are connected together by a foldable flap 26 which is integrally connected to the end panel 14 at the top edge 23. At the top edge 21 of the side panel 12 there is integrally connected a foldable flap 24. Foldable flap 28 is integrally connected at the top edge 25 of the opposite side panel 11. A triangular shaped section 31 and 33 is located at each end of the foldable flap 24 and is capable of being folded inwardly relative to the panel 24. These triangular shaped sections 31 and 33 are denoted respectively by score lines 43 and 45. A similar pair of score lines 47 and 49 are so located in conjunction with the foldable flap 28 forming respectively triangularly shaped sections 35 and 37.

Integrally connected to the upper edge of the foldable flap 24 is a handle flap 52. A similar handle flap 54 is integrally connected to the upper edge of foldable flap 28. Handle flap 52 includes a pair of spaced apart half circular shaped holes 58 and 60. Forming of the holes 58 and 60 produces respectively flaps 66 and 68 of material.

In a similar manner, handle flap 54 includes holes 62 and 64 and, during forming of the holes 62 and 64, flaps 70 and 72 of material are produced. Mounted within the enclosing container of the carton 10 is a water impermeable (plastic) bag 56. This bag 56 is adhesively secured at a height in substantial alignment to the joining of flaps 52 and 24 and flaps 54 and 28. Only the upper edge of the bag 56, approximately one quarter to one half inch in width, is to be glued to the inside surfaces of the flaps 24 and 28. This upper edge of the bag 56 is also glued to the inside surfaces of the flaps 20, 32, 38 and 41. This gluing of bag 56 is also applied against extensions 40, 44, 50 and the unnumbered extension which is integrally connected to the flap 41.

Figure 2:
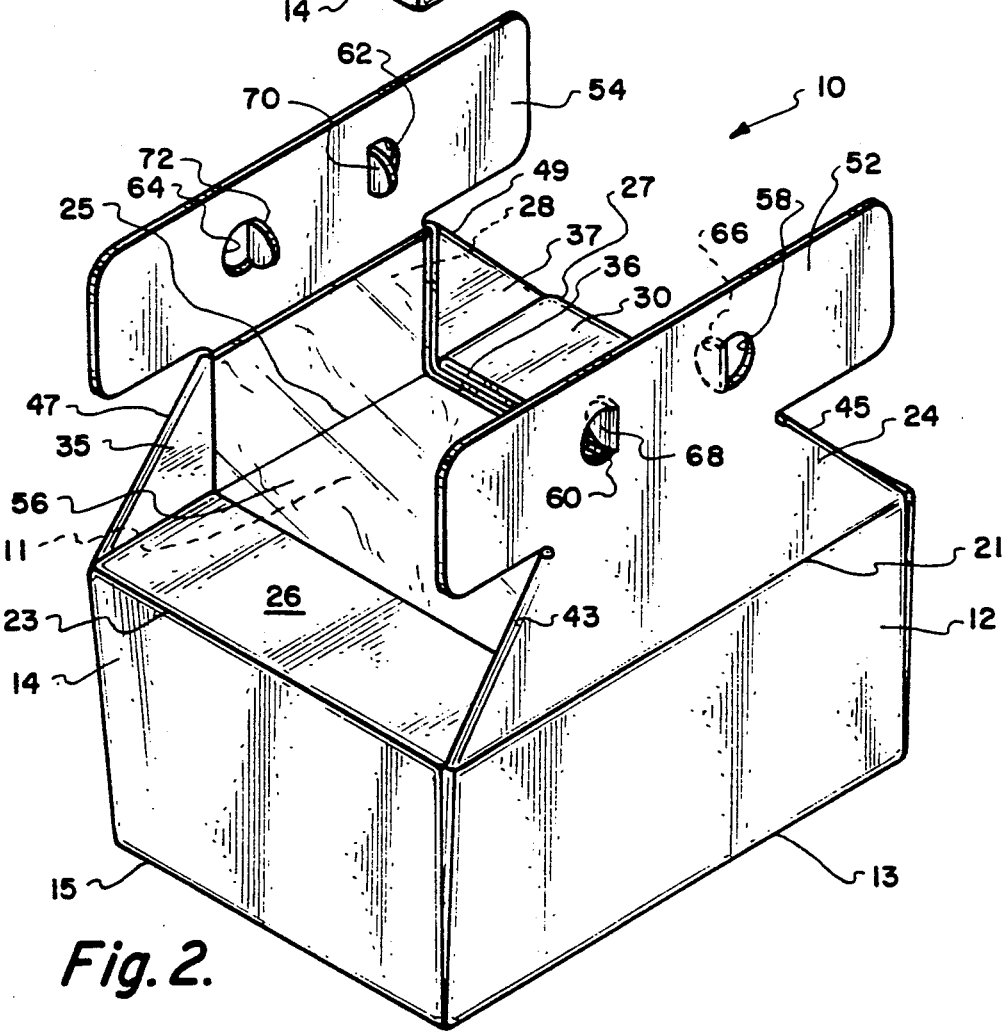
FIG. 2 is an isometric view of the carton of the present invention showing the carton in a partially open position.

The consumer will normally receive the carton 10 in the position shown in FIG. 1. When carrying of the carton 10, the consumer only needs to place a pair of fingers (or a thumb and finger) within aligned holes 60 and 64 and aligned holes 58 and 62 and apply a clamping force which will then permit the consumer to carrying the carton 10. When the consumer desires to open carton 10, the consumer only needs to separate the handle flaps 52 and 54 which have been glued with a glue that separates easily. These flaps 52 and 54, as well as flaps 24 and 28, are then moved to positions that are substantially in alignment with their respective side panels 11 and 12. This position is shown in FIG. 2 of the drawings. At this time the consumer then manually lifts flaps 26 and 30 until flap 26 is substantially in vertical alignment with end panel 14 and flap 30 is in vertical alignment with end panel 9. This position is shown in FIG. 3 of the drawings.

Figure 3:
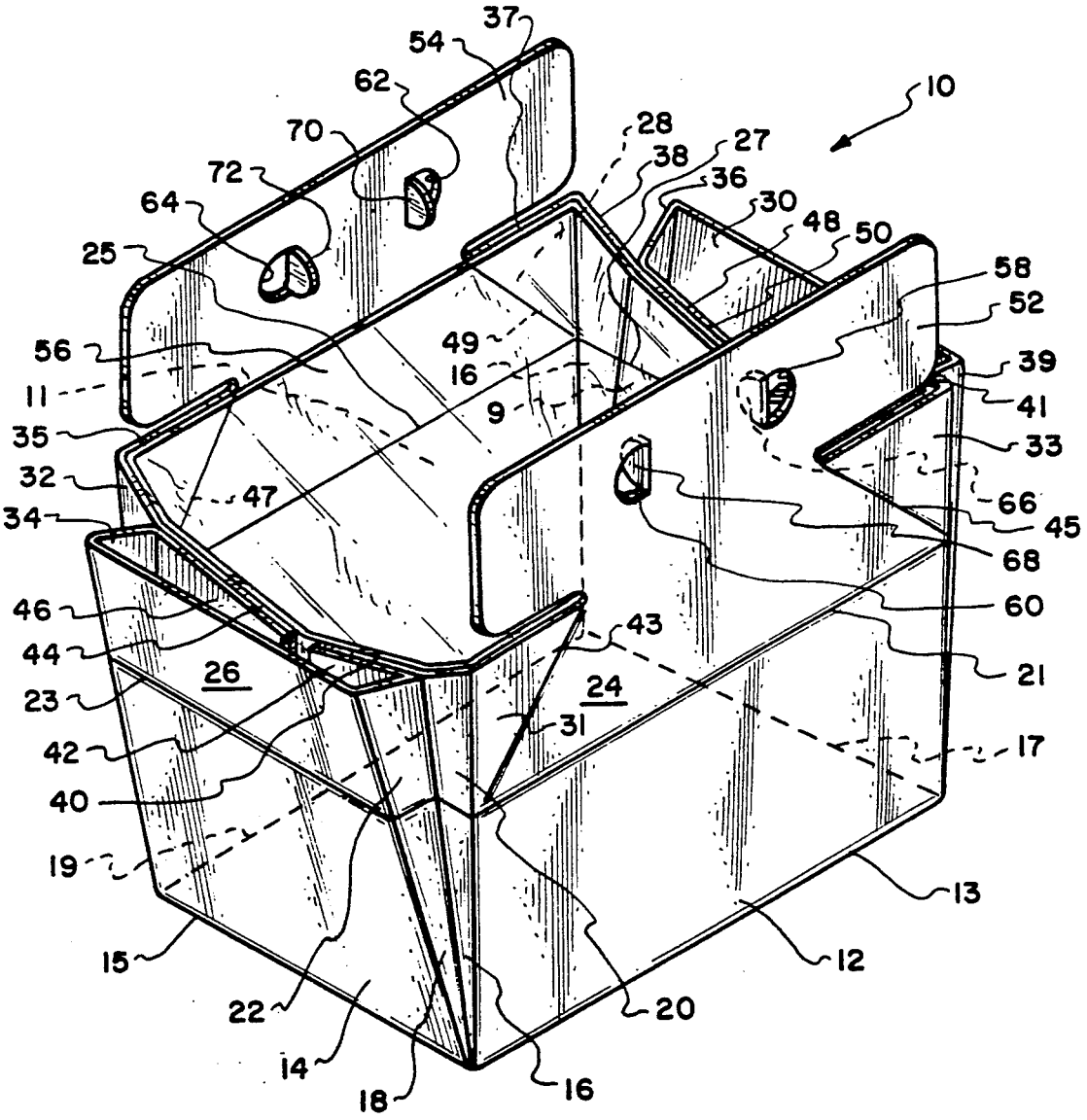
FIG. 3 is an isometric view of the carton of the present invention showing the carton in the completely open position which would permit usage of the carton as an ice bucket.

In the position shown in FIG. 3, the webs 16 and 18 of each corner have moved from an abutting position to a substantially in-line position and the same is true for the flaps 20, 22, 32, 34, 36, 38, 39 and 41. In this particular position the enclosing chamber of carton 10 has been expanded sufficiently so as to accommodate increased mass in the form of ice that is to be added as to effect cooling of the beverage containers contained within the enclosing chamber.

After the contents of the beverage containers have been consumed or otherwise utilized and the carton 10 is no longer needed, any ice and accumulated water is to be disposed of from the enclosing chamber. In order to facilitate the recycling and the reusing of the carton 10 of this invention, the bag 56 is to be manually ripped out of the enclosing chamber and disposed of by being recycled with plastic goods with the remaining portion of the carton 10 to be discarded by being recycled with paper goods.

What is claimed is:

1. A combination packaging/shipping carton and ice bucket for a plurality of beverage containers comprising:

a pair of parallel, spaced apart side panels each terminating in a pair of end edges, an end panel connecting a said end edge of one said side panel and a said end edge of the other said side panel with another end panel connecting the remaining pair of said end edges of said side panels, said end panels being parallel, said side panels and said end panels each having a bottom edge with said bottom edges being in alignment, a bottom panel connecting said bottom edges, said end panels and said side panels and said bottom panel defining an enclosing container, each said end panel and each said side panel having a top edge, said top edges being in alignment, a corner formed at each connection of a said side panel and a said end panel;

each said corner including a flange formed by an abutting pair of longitudinal extensions, said pair of longitudinal extensions for each said corner being fixedly secured together, each said flange being located within said enclosing container, each said corner further including a pair of triangular webs, each pair of said triangular webs being movable between an abutting position and a substantially in-line position, with said webs in said abutting position said enclosing container defining a minimum volume, with said webs in said in-line position said enclosing container defining an increased volume greater than said minimum volume; and foldable flaps attached to said end panels and said side panels that are to be folded upon on each other to locate said enclosing container in the position of said minimum volume, when said foldable flaps are folded upon each other said enclosing container being closed to the ambient, said foldable flaps each being movable to be in substantial alignment with their respective said side panel or said end panel which locates said enclosing container in the position of said increased volume.

2. The combination as defined in claim 1 wherein;

the interior wall surface of said side panels and said end panels and said bottom panel being covered with a water impermeable liner, said water impermeable liner being readily removable from said enclosing container thereby facilitating recycling of said carton when its useful life has ended.

3. The combination as defined in claim 2 wherein;

when said foldable flaps are folded upon each other a portion of each said triangular web being also folded.

4. The combination as been defined in claim 3 wherein;

when said foldable flaps are folded upon each other said foldable flaps that are attached to said end panels are located underneath said foldable flaps that are attached to said side panels.

5. The combination as defined in claim 4 wherein;

said foldable flaps that are attached to said side panels including handle means, said handle means facilitating manual carrying of said carton, when said foldable flaps are folded upon each other said enclosing container is closed to the ambient.

6. The combination as defined in claim 1 wherein;

when said foldable flaps are folded upon each other a portion of each said triangular web being also folded.

7. The combination as defined in claim 6 wherein:

when said foldable flaps are folded upon each other said foldable flaps that are attached to said end panels are located underneath said foldable flaps that are attached to said side panels.

8. The combination as defined in claim 7 wherein:

said foldable flaps that are attached to said side panels including handle means, said handle means facilitating manual carrying of said carton, when said foldable flaps are folded upon each other said enclosing container is closed to the ambient.

* * * * *